US005436418A

United States Patent [19]

Tamehira

[11] Patent Number: 5,436,418

[45] Date of Patent: Jul. 25, 1995

[54] CASSETTE SIZE DETECTING MECHANISM

[75] Inventor: Masato Tamehira, Yamabe, Japan

[73] Assignee: Sharp Kabushiki Kaisha, Osaka, Japan

[21] Appl. No.: 77,416

[22] Filed: Jun. 15, 1993

[30] Foreign Application Priority Data

Jun. 26, 1992 [JP] Japan ..... 4-193238

[51] Int. Cl.[6] ..... H01H 3/16

[52] U.S. Cl. ..... 200/61.58 R; 200/61.41

[58] Field of Search ..... 200/61.58 R, 329-332.1, 200/343, 61.41; 84/423 R, 423 A, 423 B, 432

[56] References Cited

U.S. PATENT DOCUMENTS

| | | | |
|---|---|---|---|
| 4,265,440 | 5/1981 | Shibazaki et al. | 271/9 |
| 4,506,122 | 3/1985 | Miyata | 200/61.58 R |
| 4,582,967 | 4/1986 | Brumit et al. | 200/5 A |
| 4,641,293 | 2/1987 | Komuro | 369/6 |
| 4,888,457 | 12/1989 | Miyakawa | 200/283 |
| 5,100,123 | 3/1992 | Kagiura et al. | 271/164 |

FOREIGN PATENT DOCUMENTS 1-58088 12/1989 Japan .

*Primary Examiner*—J. R. Scott

*Attorney, Agent, or Firm*—David G. Conlin; George W. Neuner

[57] ABSTRACT

A cassette size detecting mechanism in accordance with the present invention, comprises a cassette size detection block set 2 of blocks disposed on a cassette side; a switch operating mechanism 10, disposed on a copier body and activated by the block set 2; and switches 5 operated by the switch operating mechanism 10. The switch operating mechanism 10 comprises a plurality of actuator portions 10*a* functioning individually, a common holding portion 10*b* for holding each of the actuator portions 10*a* through a hinge portion 10*c* jointing the actuator portion 10*a* rotatably with the common holding portion 10*c*. These actuator portions 10*a*, common holding portion 10*b* are integrally formed of polypropylene material through hinge portions 10*c*.

3 Claims, 5 Drawing Sheets

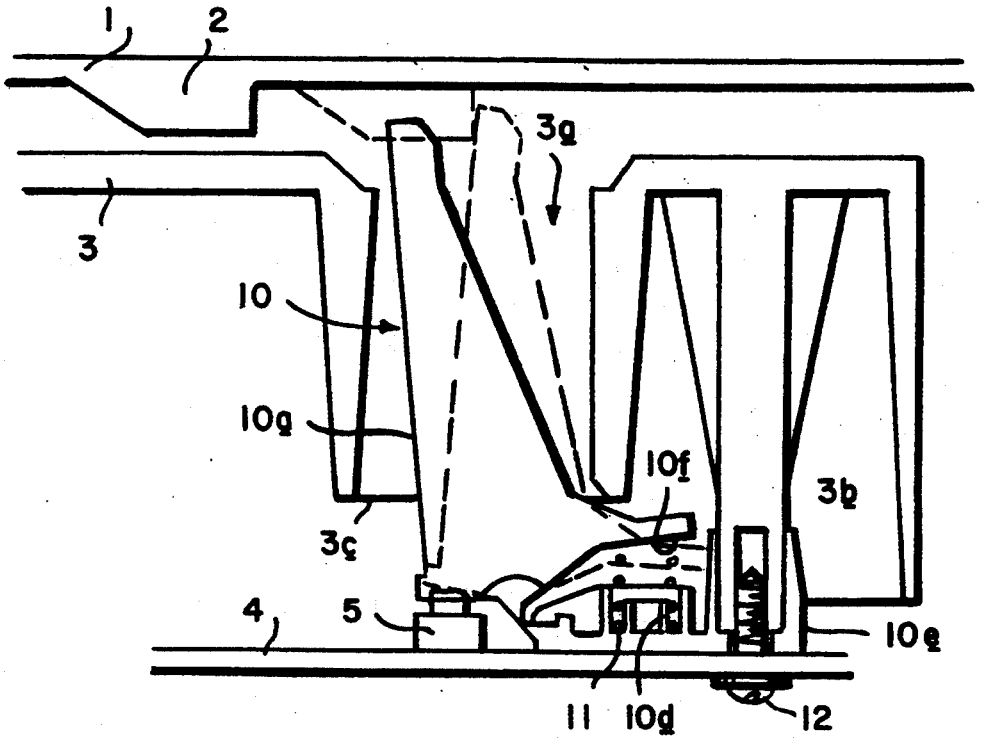
FIG. 3
FIG.8
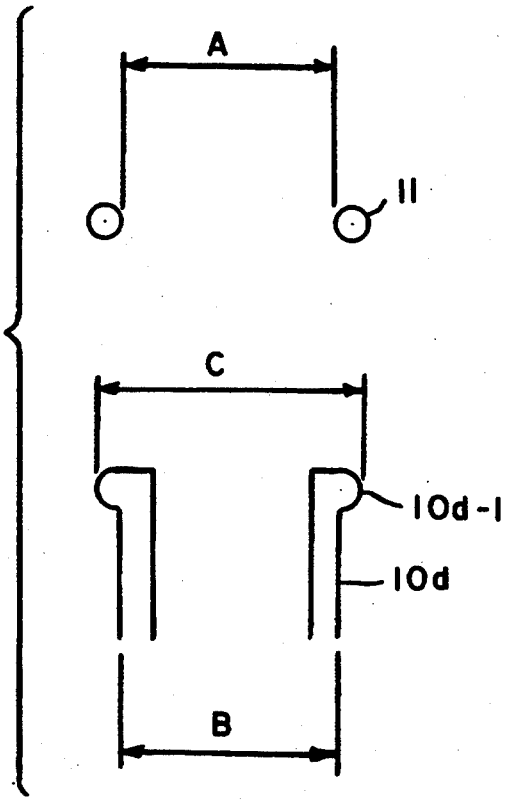

CASSETTE SIZE DETECTING MECHANISM

BACKGROUND OF THE INVENTION (1) Field of the Invention

The present invention relates to a cassette size detecting mechanism, and more particularly, to a mechanism for detecting a size of a sheet cassette for accommodating cut sheets for copy or print used in copiers, printers and the like.

(2) Description of the Prior Art

In copiers, printers, etc., use of the sheet is made of cut sheets that are cut in advance in predetermined sizes such as, for example, B5, B4, A4, A3 of JIS. The cut sheets are in general accommodated in cassettes that can be attached to and detached from the body of a copier or the like. In order for the copier body to detect the size of sheets contained in a cassette, there is provided typically three cassette size detection blocks on a side of the cassette, and the shape of blocks or combination of recess and projection of the blocks is used to identify the size of sheets of, maximally, third power of 2, or eight kinds.

One example of such prior art cassettes is shown by a schematic side view in FIG. 1. In the figure, a cassette 1 is provided on its one side with a cassette size detection block set 2. Provided for the copier body is a cassette insertion guide frame 3, to which a printed-circuit board 4, tact switches 5, size detecting levers 6 and other members are equipped.

Typically, three spaces for blocks are provided for detection block set 2, and the combination of recessed and projected shapes of the blocks is adapted to correspond to a size of sheets held in a cassette.

On the other hand, cassette insertion guide frame 3 includes a printed-circuit board 4 disposed in parallel with the cassette side, as well as a guide frame. Further, there are provided on the printed-circuit board 4 a row of tact switches 5 in a position facing the above-mentioned detection block set 2. Caulked on the printed-circuit board 4 is actuators 6 each made of a leaf spring for turning on and off the tact switch 5 in link with insertion and withdrawal of the cassette (See FIG. 2). A state of leaf spring (actuator) 6 indicated by a broken line 6-1 shows one in which tact switch 5 is engaged in operation by a block of detection block set 2.

As the prior art cassette size detecting mechanism described above uses leaf spring actuators, if the insertion and withdrawal of the cassette is practiced roughly, the actuators might be deformed, or alternatively, if the cassette remains inserted in a prolonged period of time, the leaf springs for the actuators may be worn out to be deformed, causing failure in size detection.

The main cause of defective size detection as described above has been known to be attributed to the use of leaf springs that are subject to deform. Nevertheless, in order to solve the cause, there have been problems such that an expensive, complicated switch operating mechanism should be required.

SUMMARY OF THE INVENTION

It is therefore an object of the present invention to provide a cassette size detecting mechanism having high reliability at low cost, wherein a holding portion constituting a base member and actuator portions being developed at hinge portions as centers thereof can be integrally molded with polypropylene material.

The above object of the present invention can be achieved by providing a cassette size detecting mechanism comprising: a cassette size detection block set of a plurality of blocks disposed on a cassette side; a switch operating mechanism, disposed on a copier body and activated by the block set; and switch means operated by the switch operating mechanism, the switch operating mechanism comprising a plurality of actuator portions functioning individually, a common holding portion for holding each of the actuator portions through a hinge portion so as to joint each of the actuator portion rotatably with the common holding portion, wherein the actuator portions and the common holding portion are integrally formed of polypropylene material through the hinge portions. Besides, the aforementioned switch operating mechanism may be able to be integrally molded in a state in which each of the actuator portions is developed from the common holding portion at the hinge portion as a center thereof. Further the aforementioned common holding portion comprises cylindrical portions each receiving a spring for pressing the actuator portion and including an undercut portion for retaining the spring.

In accordance with the present invention, since holding portion constituting a base member and actuator portions developed at hinge portions can be integrally molded with polypropylene material, a cassette size detecting mechanism having high reliability can be provided at low cost.

BRIEF DESCRIPTION OF THE DRAWINGS

FIG. 3 is a constructional view of main components for illustrating an embodiment of a cassette size detecting mechanism in accordance with the present invention;

FIG. 8 is a view showing a way of attachment of a spring.

DESCRIPTION OF THE PREFERRED EMBODIMENTS

Figure 1:
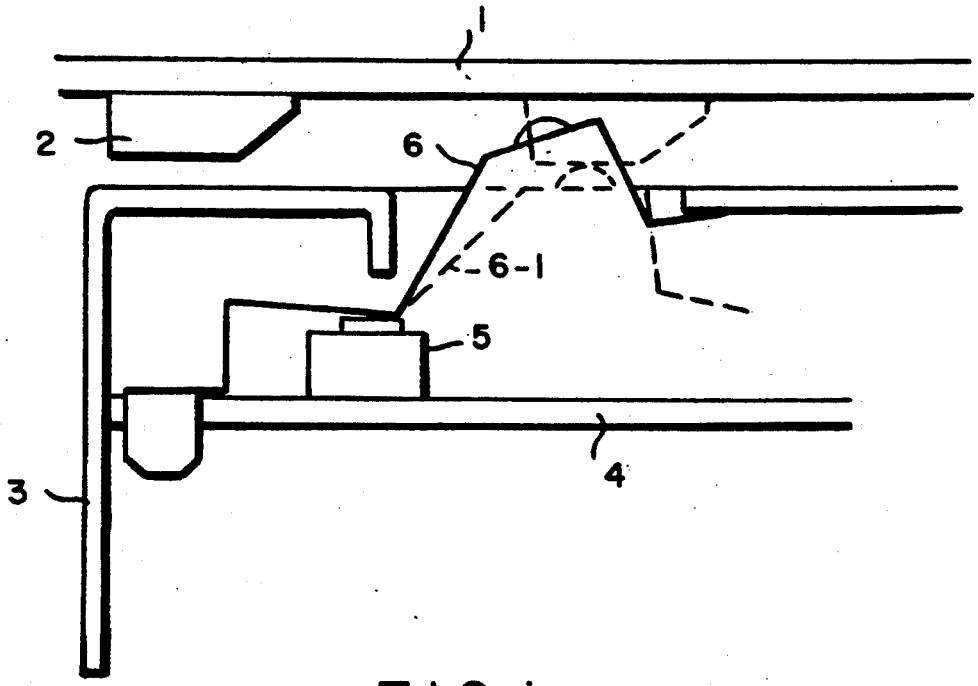
FIG. 1 PRIOR ART
FIG. 1 is a view for illustrating an example of a switch operating mechanism using a prior art leaf spring.
Figure 2:
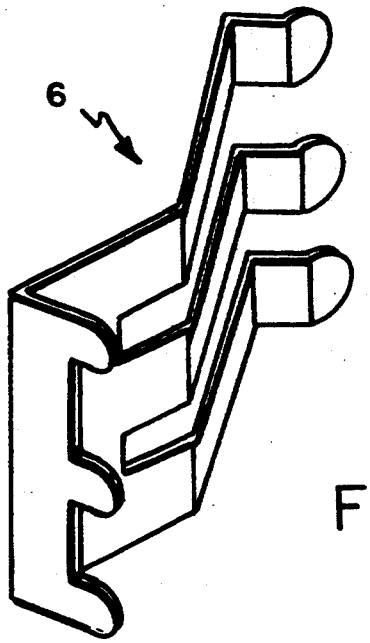
FIG. 2 PRIOR ART
FIG. 2 is a perspective view showing an example of a prior art leaf spring.

FIG. 3 is a constructional view of main components for illustrating an embodiment of a cassette size detecting mechanism in accordance with the present invention. In the figure, there are a cassette 1, a detection block set 2 disposed on one side of the cassette 1, a cassette insertion guide frame 3 disposed in a copier main body, a printed-circuit board 4, tact switches 5 and a switch operating mechanism 10 associated with the present invention. Provided on the side of cassette 1 is detection block set 2 indicating a size of sheets contained by the combination of position and number of blocks, for example, there may be provided a row of three spaces for blocks, and the combination of their presence and absence can be used to identify a corresponding size of sheet. A pair of cassette insertion frames 3 are provided on the copier main body adjacent to both sides of the cassette, and cassette 1 is inserted along the guide frames 3 into the copier body. There is provided in guide frame 3 a square hole 3*a* in a position corresponding to detection block set 2. Provided on the outer side of guide frame 3 are a boss 3*b* for securing printed-circuit board 4 and a guide rib 3*c* for regulating backlash when switch operating mechanism 10 is swiveled. In this connection, tact switches 5 are attached to printed-circuit boad 4.

Switch operating mechanism 10 comprises actuator portions 10*a* for turning tact switches on and off in link with detection block set 2; a holding portion 10*b*, having springs 11 for imparting pressure force required for causing actuator portions 10*a* to turn on switches 5 and fixing entire switch operating mechanism 10 to guide frame 3 and a printed-circuit board 4; and hinge portions 10*c*, jointing actuator portions 10*a* to holding portion 10*b* and functioning as rotary supports for actuator portions 10*a*. Thus, switch operating mechanism 10 includes hinge portions 10*c* that are required to be opened and closed repeatedly, therefore there is necessity to use a resin material represented by polypropylene which is excellent in repeatability for bending up and down.

Figure 4:
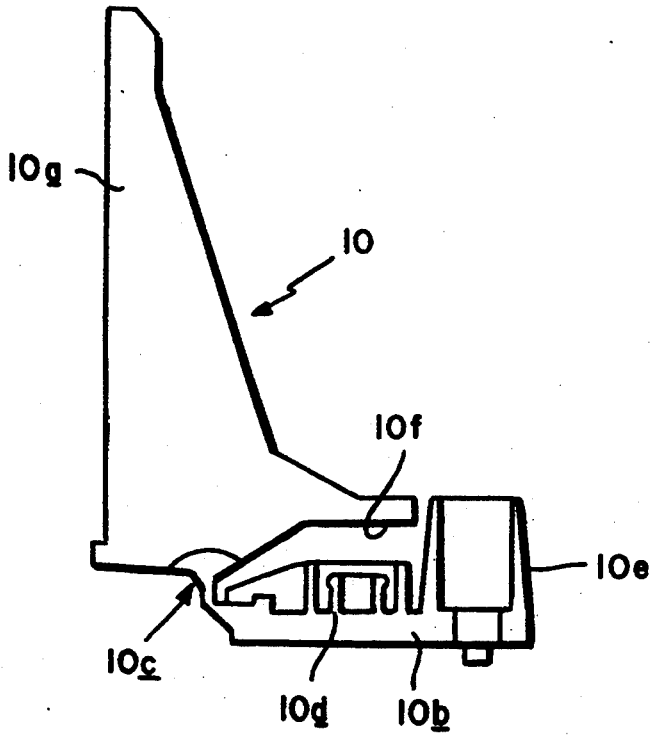
FIG. 4 is a side view showing an embodiment of a switch operating mechanism in accordance with the present invention.
Figure 5:
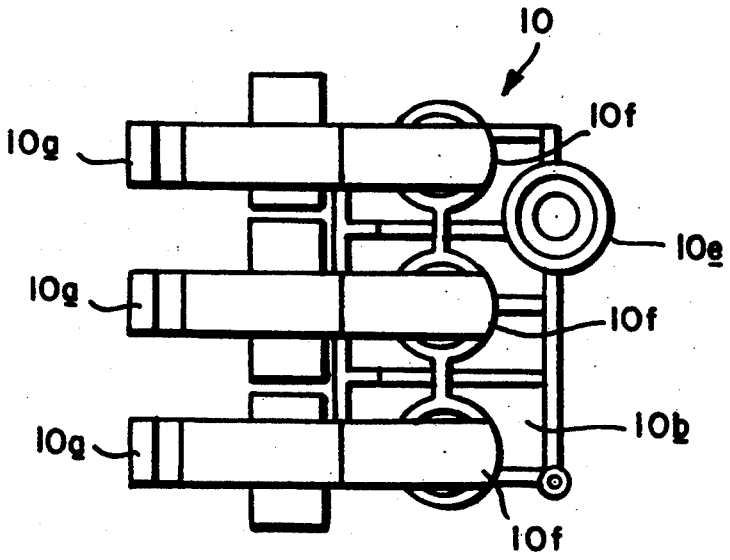
FIG. 5 is a plan view showing the switch operating mechanism shown in FIG. 4.

FIG. 4 is a side view showing switch operating mechanism 10 in operation, and FIG. 5 is a plan view of FIG. 4. In view of the shape as in this operative state, there are several undercut portions in various positions, so that the metal die structure becomes complicated resulting in expansiveness, or unfeasibleness to produce a metal die structure.

Figure 6:
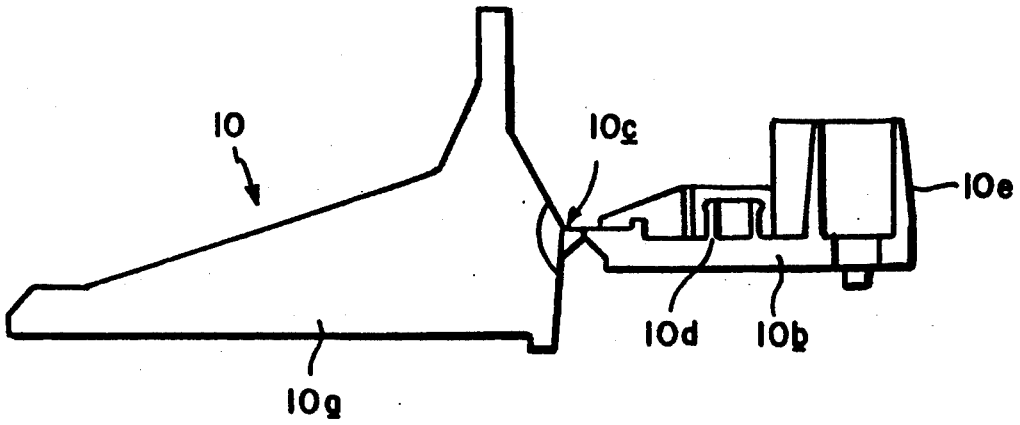
FIG. 6 is a developed side view of the switch operating mechanism shown in FIG. 4.

Therefore, if the molding is considered to be executed in a state in which actuator portions 10*a* are opened at right angle (90°) as shown in FIG. 6, the shape has no undercut portion, so that a metal die having a simple cavity core structure can be realized.

Figure 7:
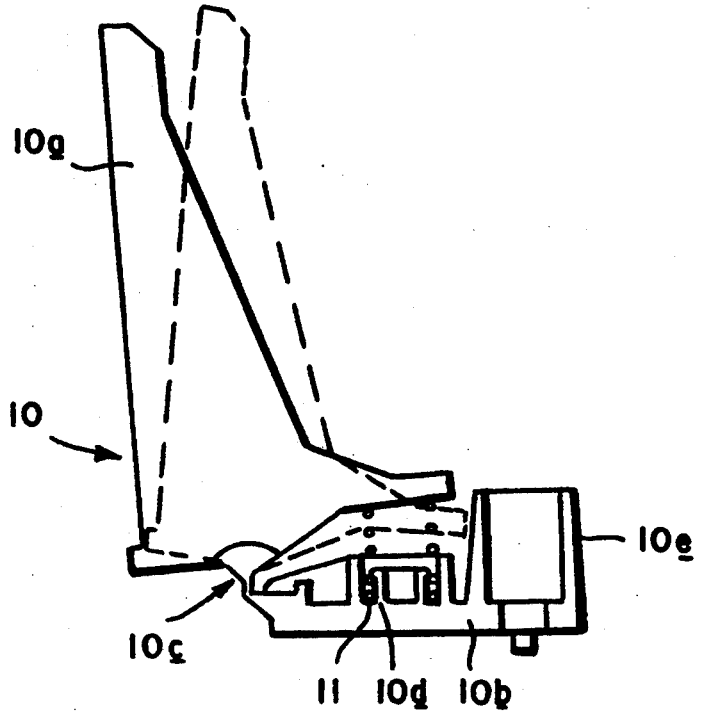
FIG. 7 is a view showing a state of the switch operating mechanism shown in FIG. 4 in which a spring is built.
Figure 9:
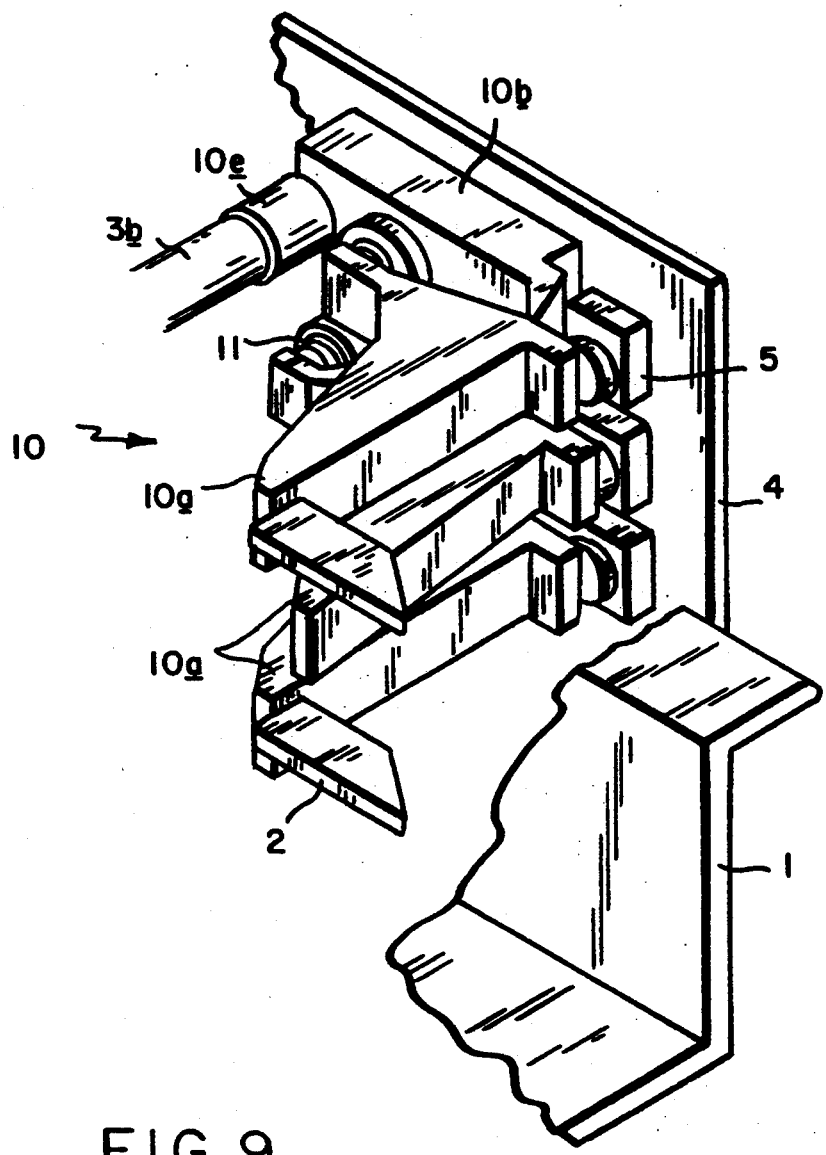
FIG. 9 is a partial isometric view illustrating the individual actuator portions and switch operating mechanism.

Attachment of a size detection spring 11 for pressing actuator 10*a* to holding portion 10*b* is carried out as shown in FIG. 7, by providing a cylindrical portion 10*d* having an outer diameter B matching with an inner diameter A of spring coil 11 as shown in FIG. 8, while providing as a part of the cylindrical portion a rim flange 10*d*-1 having a diameter C greater than the inner diameter A, (for example, C=A+0.1 to 0.2 mm) for preventing the spring coil from being drawn out. This configuration requires to form some undercut structure in the metal die, bringing about difficulty to molding with a normal molding material, but it is possible to mold the member and draw forcibly by taking advantage of the characteristic of polypropylene material thus, the mold can be separated, yet have an undercut.

Next, description will be made of the attachment of switch operating mechanism 10 in accordance with the invention. In the beginning, while switch operating mechanism 10 is spread out or developed as shown in FIG. 6, size detection springs 11 are attached to respective cylindrical portions 10*d*. Then, the switch operating mechanism 10 is bent at hinge portion 10*c* so as to make a predetermined angle assuming a state shown in FIG. 7. In this state, a cylindrical portion 10*e* of switch operating mechanism 10 is fit in boss 3*b* of guide frame 3 in the main body. Then, the above arrangement is set over the printed-circuit board 4 equipped with detection switches 5, and is screwed onto boss 3*d* of guide frame 3 with a screw 12 to be secured, whereby the arrangement can assume the state shown in FIG. 3, in which size detection switch 5 is turned on. In the prior art structure in which the switches are changed over from off-state to on-state, the switches might be broken or become inoperative due to excessive insertion of cassette attributed to the displacement of the insertion amount of the cassette or attributed to the deviation of dimensions in structure of the main body and cassette, etc., whereas the switch might fail to perform the detection if the insertion amount is insufficient. In contrast to this, in switch operating mechanism 10 in accordance with the invention, because the pressure on size detecting switches 5 is dependent upon the loading of spring 11, the insertion of the cassette does not give any load to the switches, so that excellent operation performance can be obtained.

When cassette 1 is inserted, the element of size detection block 2 abuts against actuator portion 10*a*, which in turn rotates on hinge portion 10*c* as its supporting center up to a position indicated by the broken line in FIG. 3, whereby switch 5 turns off. In this arrangement, when the inserted amount of cassette 1 is taken so as to have a margin beyond the off-point of switch 5, detection failure can be prevented.

In accordance with the invention, since a holding portion constituting a base portion and a plurality of actuator portions are jointed through hinges and integrally formed of polypropylene material and the thus formed structure is built in with springs, it is possible to produce a switch operating mechanism as inexpensive as the prior art switch operating mechanism formed by a leaf spring.

Since the actuator portion is made of resin material of polypropylene, it is possible to provide a switch operating mechanism having high reliability free from deterioration and deformation due to rough handling and wearout.

In the prior art molding of the mechanism would require complicated procedures for processing undercut portions or been impossible to be carried out, but since the molding of the invention is carried out in such a manner that the actuator portions are spread out or developed at respective hinges with respect to the holding portion, the molding with a metal die can be practiced using a simple top-and-bottom split metal die.

Since the use of polypropylene material facilitates to form undercut shapes for preventing pressure springs for pressing the actuators from being drawn out, it is possible to leave out members for holding the springs.

What is claimed is:

1. A cassette size detecting mechanism comprising:

a cassette size detection block set of a plurality of blocks disposed on a cassette side; a switch operating mechanism, disposed on a copier body in a position facing said block set and activated by said block set; and a plurality of switches operated individually by said switch operating mechanism, said switch operating mechanism comprising a plurality of actuator portions operating said switches individually, a common holding portion for holding each of said actuator portions through a hinge portion so as to join each of said actuator portion rotatably with said common holding portion, characterized in that said actuator portions and said common holding portion are integrally formed of polypropylene material through said hinge portions.

2. A cassette size detecting mechanism according to claim 1 wherein said switch operating mechanism is able to be integrally molded in a state in which said actuator portions are developed from said common holding portion at said hinge portions as the center thereof.

3. A cassette size detecting mechanism according to claim 1 or 2 wherein said common holding portion comprises cylindrical portions each receiving a spring for pressing said actuator portion and including a rim flange for retaining said spring.

* * * * *